United States Patent [19]

Dubich et al.

[11] Patent Number: 4,548,016

[45] Date of Patent: Oct. 22, 1985

[54] MEMBRANE FASTENER APPARATUS

[75] Inventors: Charles S. Dubich, Akron; James H. C. Yang, Cleveland, both of Ohio

[73] Assignee: The Firestone Tire & Rubber Company, Akron, Ohio

[21] Appl. No.: 524,511

[22] Filed: Aug. 18, 1983

[51] Int. Cl.[4] ..... E04D 15/00

[52] U.S. Cl. ..... 52/749; 404/107; 404/87

[58] Field of Search ..... 52/222, 63, 528, 749; 404/74, 87, 107

[56] References Cited

U.S. PATENT DOCUMENTS

| | | | |
|---|---|---|---|
| 1,997,216 | 4/1935 | Heltzel | 404/87 X |
| 2,025,449 | 12/1935 | Heltzel | 94/39 |
| 2,045,256 | 6/1936 | Voigt et al. | 94/39 |
| 3,364,828 | 1/1968 | Shope et al. | 94/39 |
| 3,395,627 | 8/1968 | Barton | 94/51 |
| 3,416,415 | 12/1968 | Worson . | |
| 3,532,032 | 10/1970 | Weber | 404/87 |
| 3,876,323 | 4/1975 | Williams | 404/87 |

*Primary Examiner*—Carl D. Friedman
*Assistant Examiner*—Creighton Smith
*Attorney, Agent, or Firm*—Ernst H. Ruf

[57] ABSTRACT

Apparatus for compressing an elongated strip of resilient material and inserting the strip, together with a flexible membrane, into a channel member supported on a substrate wherein the apparatus includes a frame assembly, supporting and moving structure for the frame assembly; pairs of converging roller assemblies for receiving and temporarily elastically deforming the strip of resilient material into an inverted V-shape; a grip wheel for gripping the apex portion of the inverted V-shaped strip and pushing at least a portion thereof, together with abutting portions of the flexible membrane, into the channel member; and a pressing tool for inserting the strip fully into the channel member and thereafter returning the strip to approximately its natural shape to thereby frictionally retain adjacent portions of the flexible membrane within the channel member.

6 Claims, 8 Drawing Figures

MEMBRANE FASTENER APPARATUS

TECHNICAL FIELD

The field of art to which this invention pertains is that of mechanical fastening systems, particularly to apparatus or tools for securing a flexible membrane, overlaying a channel member, to the channel member via an elongated strip of generally flat resilient material. The channel member is initially fastened to the roofing substrate and has a predetermined width opening, narrower than the width of the strip.

BACKGROUND OF THE ART

A large number of commercial and factory or plant roofs are of a flat roof design wherein the roofing material itself is often of built-up asphalt and, in more modern systems, of a single ply EPDM elastomeric sheet or membrane. In terms of securing a single ply EPDM membrane to the roof itself, one common design utilized is the mechanical ballast system that uses a layer of stone over the membrane. While the ballast system is least expensive, it has the disadvantage of being quite heavy (about 10 lbs. per square foot) thus requiring a heavy roof support structure and, in addition, the roof slope cannot exceed 10°.

Adhered roof membrane retention systems suffer from a cost penalty while mechanical fastening systems generally require a fixation to the roof substrate by metal fasteners with metal or rubberized nailing strips. Additional sealing strips or caps are then required to keep the punctured membrane water tight. Such installations are cumbersome as well as time-consuming in addition to violating the integrity of the membrane itself.

Copending U.S. Application Ser. No. 516,522 to Yang, et al., filed July 25, 1983 and assigned to common assignee, discloses a mechanical fastening system for securing a flexible sheet within a channel member via an insert member wherein the latter is made of flexible resilient material having a central longitudinal flex notch that serves to define two adjacent wing portions and permits a temporary elastic deformation of the insert member into an inverted V-shape for insertion of the insert member, together with adjacent portions of the flexible sheet, into the channel member. In the interest of full disclosure, the previously-noted application is incorporated herein by reference to the extent necessary to explain this particular mechanical fastening system.

The prior art construction set forth in U.S. Pat. No. 3,532,032 to Weber discloses a machine for sealing joints comprising a handlebar assembly attached to a yoke which comprises a series of parallel bars. The bars, in turn, attach to a pressure wheel located behind a series of opposed roller elements. The tool is used for transversely compressing a sealing strip and then placing the strip inside a channel. A handled portion can be attached to rubber wheels or can be positioned over a first set of wheels. Rollers are mounted on compressor plates which are mutually angled in order that the sealing strip is gradually compressed when passing between the rollers.

U.S. Pat. No. 2,025,449 to Heltzel discloses a machine for placing a strip between pavement slabs. The apparatus comprises a U-shaped channel member which is placed inside wet concrete; a blade portion which is mounted within the channel portion; a pair of grooved folding discs having substantially concave circumferences which are mounted on top of the blade; and a strip made of an appropriate material which is oriented to be deposited within the concrete. In operation, the strip is fed over the inclined edge of the blade whereupon it is contacted by grooved folding disc and folded into an inverted V-shape. The strip of the material than passes over the blade where it is then inserted into the concrete at the end of the blade to form a sealing joint member. As shown in FIG. 11, in a further embodiment, a rotary disc is used to compress and shape the strip in the concrete.

U.S. Pat. No. 1,997,216 to Heltzel in FIG. 16 discloses a compressing tool attached to a substantially U-shaped frame which in turn attaches to a tubular handle. A disc is rolled between guide blades such that it will cut a groove in concrete and depress the joint strip into the groove.

U.S. Pat. No. 2,045,256 to Voigt, et al. discloses a machine for compressing a pre-formed strip and placing the strip within a joint. As shown in FIG. 7, the machine comprises a reel portion mounted on top of a frame for feeding the rolling strip through inclined discs such that the strip is decreased along its transverse width. The strip is then pressurized by means of an air hammer such that it will be placed downward into the joint in an appropriate position. Located on either side of the discs are a pair of bevelled rollers which contact each side of the discs in order to compress the space between the discs.

U.S. Pat. No. 3,364,828 to Shope, et al. discloses a strip inserting apparatus to compress and place a strip between paving sections wherein the apparatus comprises a pair of parallel side members relative to which are mounted a set of opposed rollers. Located behind the rollers is a compression disc which has a V-shaped circumferential cross section that substantially places and pushes the strip into a joint.

U.S. Pat. No. 3,395,627 to Barton discloses a sealing-strip placing apparatus comprising a tubular portion which is attached to a handle portion. At the mid-point of the tubular portion are a pair of axles which extend from a central joint to support wheels. The strip material is supported on a roller wheel which is attached to the handlebar in order that the material can be transported and placed into the channel. To accomplish this, the material is fed through a lubricator box which contains a pair of substantially opposed rollers disposed at angles relative to one another such that the strip is pressed into a V-shape. However, the strip is placed into the joint by means of a tube which extends below the cart into the joint.

DISCLOSURE OF THE INVENTION

The present invention provides a solution to the prior art problems and to the previously-discussed prior art constructions by providing tools that sequentially horizontally deform the flexible resilient strip into an inverted V-shape; thereafter grip and apex portion of the inverted V-shape strip and push the strip together with the abutting portions of the flexible membrane into the channel member. Subsequently, the apex portion of the inverted V-shaped insert strip is contacted to both fully insert the strip into the channel member and thereafter return the strip to approximately its natural shape so as to frictionally and non-bindingly retain adjacent portions of the membrane within the channel member.

The apparatus or tools of the present invention take the form of a manually-actuated placing tool assembly that may be combined with a pressing tool assembly.

The placing tool assembly includes a frame assembly together with means for supporting the former a predetermined distance above the substrate, including means for moving the frame assembly along and over the substrate. Two pairs of converging tandem roller assemblies are utilized for temporarily elastically deforming the strip of insert material into an inverted V-shape. An insert wheel, in tandem with the roller assemblies includes a peripheral cavity for gripping the apex portion of the inverted V-shaped strip and pushing at least a portion thereof together with the abutting portions of the flexible membrane into the channel member.

The pressing tool assembly includes a journaled wheel member that extends into the channel member and is adapted to come into gradual contact with the apex portion of the inverted V-shaped strip to both fully insert same into the channel member and thereafter return the strip to approximately its natural shape so as to frictionally yet non-bindingly retain adjacent portions of the membrane within the channel member without violating the integrity of the membrane.

Preferably at least a portion of the support means is pivotable in relation to the frame assembly and the pressing tool assembly is preferably yieldably mounted relative to the support means.

Other features and advantages of the present invention will become more readily understood by persons skilled in the art when following the best mode description in conjunction with the several drawings.

BEST MODE FOR CARRYING OUT THE INVENTION

Figure 1:
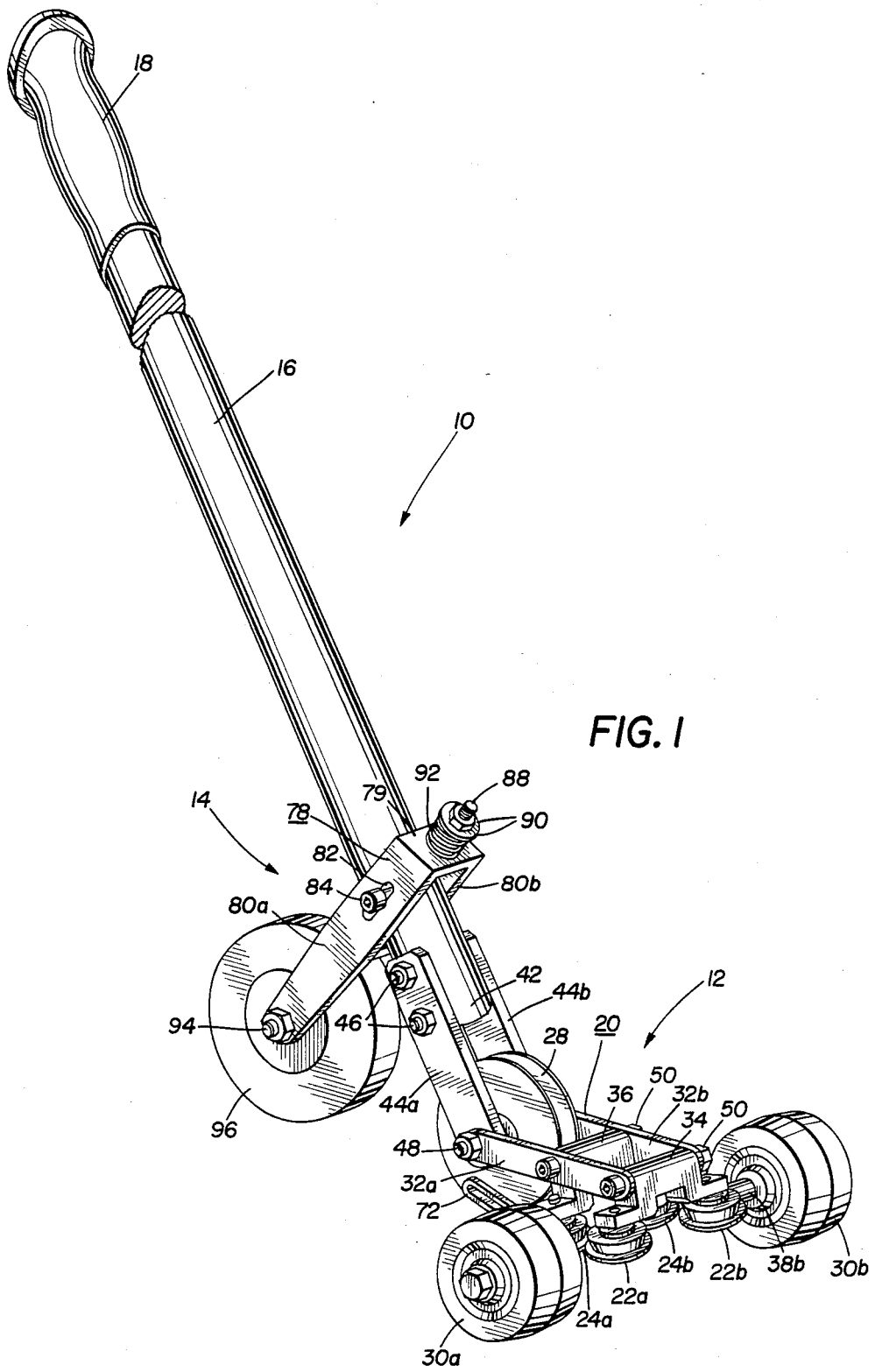
FIG. 1 is a perspective view of one of the flexible or roofing membrane fastener tools of the present invention.

Referring now to the drawings, specifically FIG. 1, there is illustrated a perspective view of a roofing or flexible member fastener tool or apparatus, generally denominated by numeral 10. Fastener tool 10 is a combination of a placing tool assembly 12 and a pressing tool assembly 14, joined by a common actuating handle 16 having a hand grip portion 18 on its distal end 18.

Turning first to placing tool assembly 12, it in turn is made up of three subassemblies, namely two pairs of tandem rollers 22*a*, 22*b* and 24*a*, 24*b* together with grip and insert wheel 28 as well as a set of spaced support wheels 30*a*, 30*b*. The noted three subassemblies of placing tool assembly 12 are joined together via two parallel bars 32*a*, 32*b*, front roller yoke 34, rear roller yoke 36 as well as support wheel axles 38*a*, 38*b*. Connection with the proximate end 42 of actuating handle 16 is via two parallel spaced bars 44*a*, 44*b*, the outer ends of which are physically attached to handle portion 42 via nut and bolt assemblies 46. The inner ends of bars 44 and bars 32 are joined by a further nut and bolt assembly 48 which also serves to both rotatably journal grip and insert wheel 28 as well as permitting the pivotal movement of handle 16 relative to frame assembly 20 to be discussed hereafter. Further nut and bolt assemblies 50 serve to retain front and rear roller yokes 34 and 36 in a spaced tandem relationship. Yokes 34, 36 together with bars 32*a*, 32*b* function as a frame assembly 20 for placing tool assembly 12.

Figure 3:
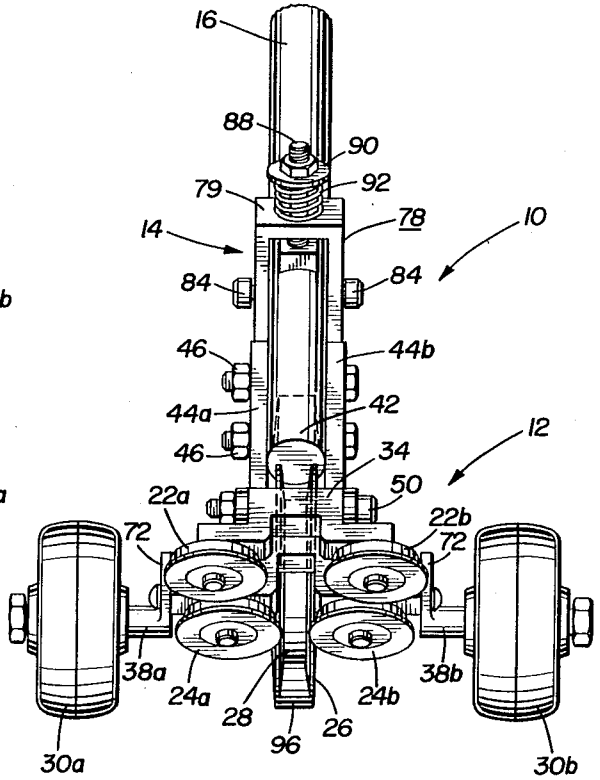
FIG. 3 is a front-end elevational view of the noted tool.
Figure 2:
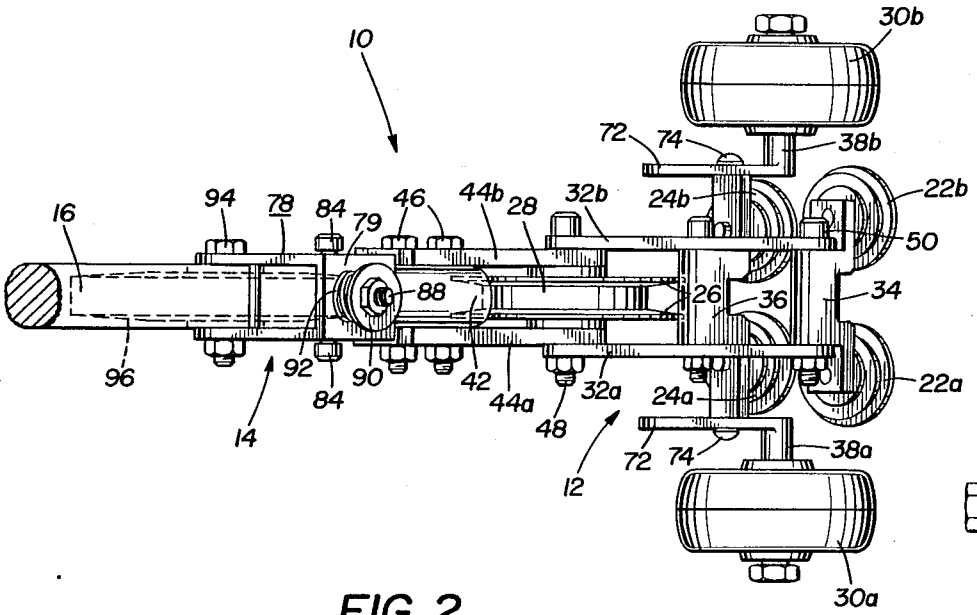
FIG. 2 is a top plan view, partially in section, of the tool of FIG. 1.
Figure 6:
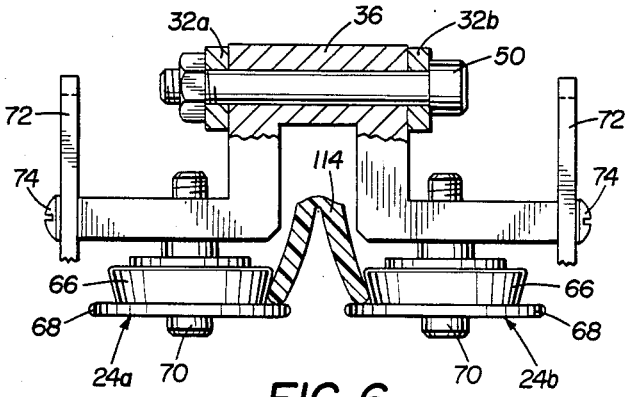
FIG. 6 is a fragmentary cross-sectional view through the rear roller assembly, taken substantially on the plane indicated by line 6—6 in FIG. 4.
Figure 5:
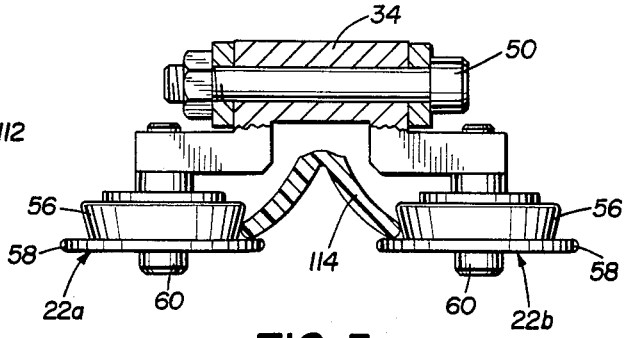
FIG. 5 is a fragmentary cross-sectional view through the front roller assembly, taken substantially on the plane indicated by lines 5—5 in FIG. 4.

Front roller yoke 34 is utilized for mounting a pair of transversely spaced rollers 22*a*, 22*b* having tapered annular vertical surfaces 56 and adjacent lower extending flange portions 58, with rollers 22*a*, 22*b* being rotatably journaled on generally vertically disposed bolts 60. In a similar manner, rear roller yoke 36 is utilized for mounting a second pair of spaced rollers 24*a*, 24*b* also having tapered annular surfaces 66 that merge into lower flange portions 68, with roller 24*a*, 24*b* rotatably supported on generally vertically disposed bolts 70. As best seen in FIGS. 3, 5 and 6, the axial spacing between rollers 24*a*, 24*b* is less than the axial spacing between rollers 22*a*, 22*b*. In addition, as best seen in FIGS. 1, 2 and 6, adjustment portions 72 of support wheel axles 38*a*, 38*b* are bolted to yoke 36, via bolts 74 in a manner so as to permit adjustment of axles 38*a*, 38*b* and consequently wheels 30*a*, 30*b* relative to placing tool assembly 12.

Figure 8:
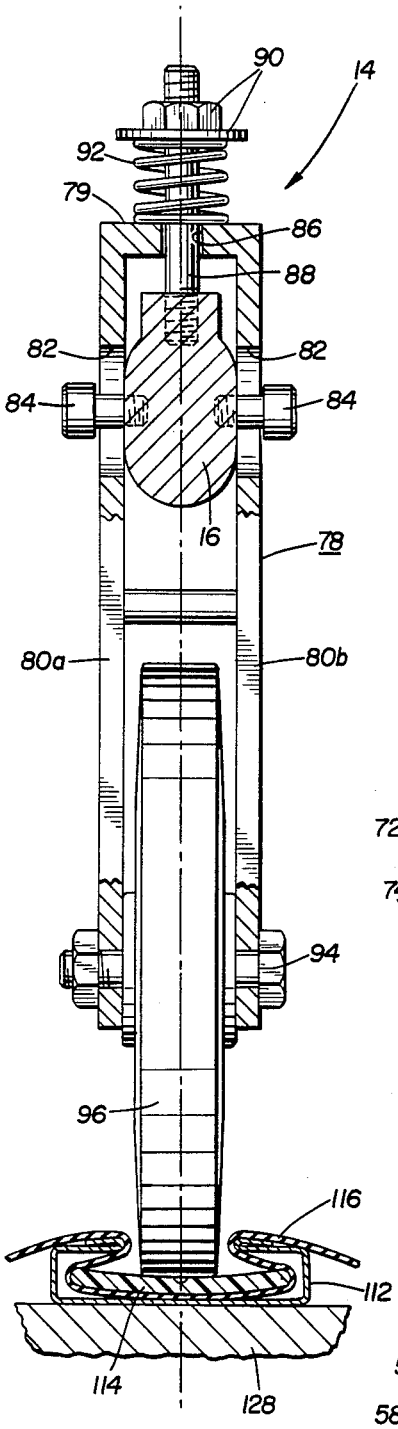
FIG. 8 is a cross-sectional view of the pressing tool taken substantially on the plane indicated by lines 8—8 in FIG. 4.

Turning now to pressing tool assembly 14, which is best shown in FIGS. 1 and 8, it includes a generally U-shaped frame member or clevis 78 whose leg portions 80*a*, 80*b* are provided with elongated slots 82 through which the bodies of bolts 84 extend fixedly into actuating handle 16 to permit the axial sliding and recriprocating motion of clevis 78. Also extending from actuating handle 16, through aperture 86 in the bottom surface of clevis 78 is threaded member 88 whose outer end is provided with a nut and washer assembly 90 whose function it is to retain and provide adjustment for a spring member 92 interposed therebetween and the bottom portion 79 clevis 78, thereby slidably and yieldingly mounting clevis 78 relative to actuating handle 16. The distal ends of clevis leg portions 80*a*, 80*b* are apertured to permit the passage therethrough of nut and bolt assembly 94 which is utilized for rotatably journaling a wheel member 96, preferably of an elastic hard rubber-type composition.

Figure 7:
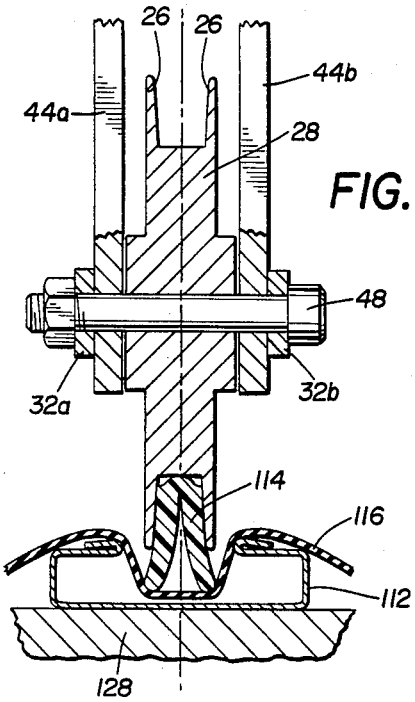
FIG. 7 is a fragmentary cross-sectional view of the placing wheel, taken substantially on the plane indicated by lines 7—7 in FIG. 4.

Prior to discussing the operation of roofing member fastener tool 10, it should be noted that tool 10 is utilized for inserting and securing a flexible sheet or membrane 116 (FIGS. 7 and 8) relative to a rigid channel member 112 of preferably generally rectangular form in transverse cross section, and having a central aperture 24 in its top surface. The retention of membrane 116 is accomplished via the use of an elongated strip of flexible material in the form of resilient insert member 114 that is adapted for retaining membrane 116 within channel member 112.

In operation, initially a plurality of channel members 112 is attached to any desired type of substrate 128

(FIGS. 7 and 8), such as a roofing structure via a plurality of fasteners (not shown). After flexible sheet or membrane 116 is placed over channel member 112, insert member 114 which is either flat, i.e., of generally rectangular form in transverse cross section or preferably slightly concavely curved (see FIG. 8) is temporarily elastically deformed into an inverted V-shape by physically rolling tool 10 on the roof, via support wheels 30*a*, 30*b*, thereby causing rollers 22*a*, 22*b* and 24*a*, 24*b* to temporarily elastically deform insert member 114 into an inverted V-shape. As best seen in FIGS. 5 and 6, member or strip 114 is successively received between rollers 22*a*, 22*b* as well as rollers 24*a*, 24*b*. Specifically the edges of member 114 are supported by roller flange portions 58, 68 and sequentially deformed between tapered surfaces 56, 66.

As deformed member 114, now in its inverted V-shape, leaves rollers 24*a*, 24*b* at least the apex thereof enters into the tapered slot or cavity formed by grip and insert wheel annular flange portions 26. Wheel 28 in turn then pushes deformed insert member 114, together with the abutting portion of membrane 116 vertically into channel member 112 until membrane 116, touches the bottom wall of channel member 112. Thereafter, as insert member 114 emerges from between grip and insert wheel flange portions 26, it tends to expand within channel member 112 until it is constrained from further doing so by the edges of the slot in the tip surface of channel member 112 and thus assumes an approximately triangular shape in cross section.

Figure 4:
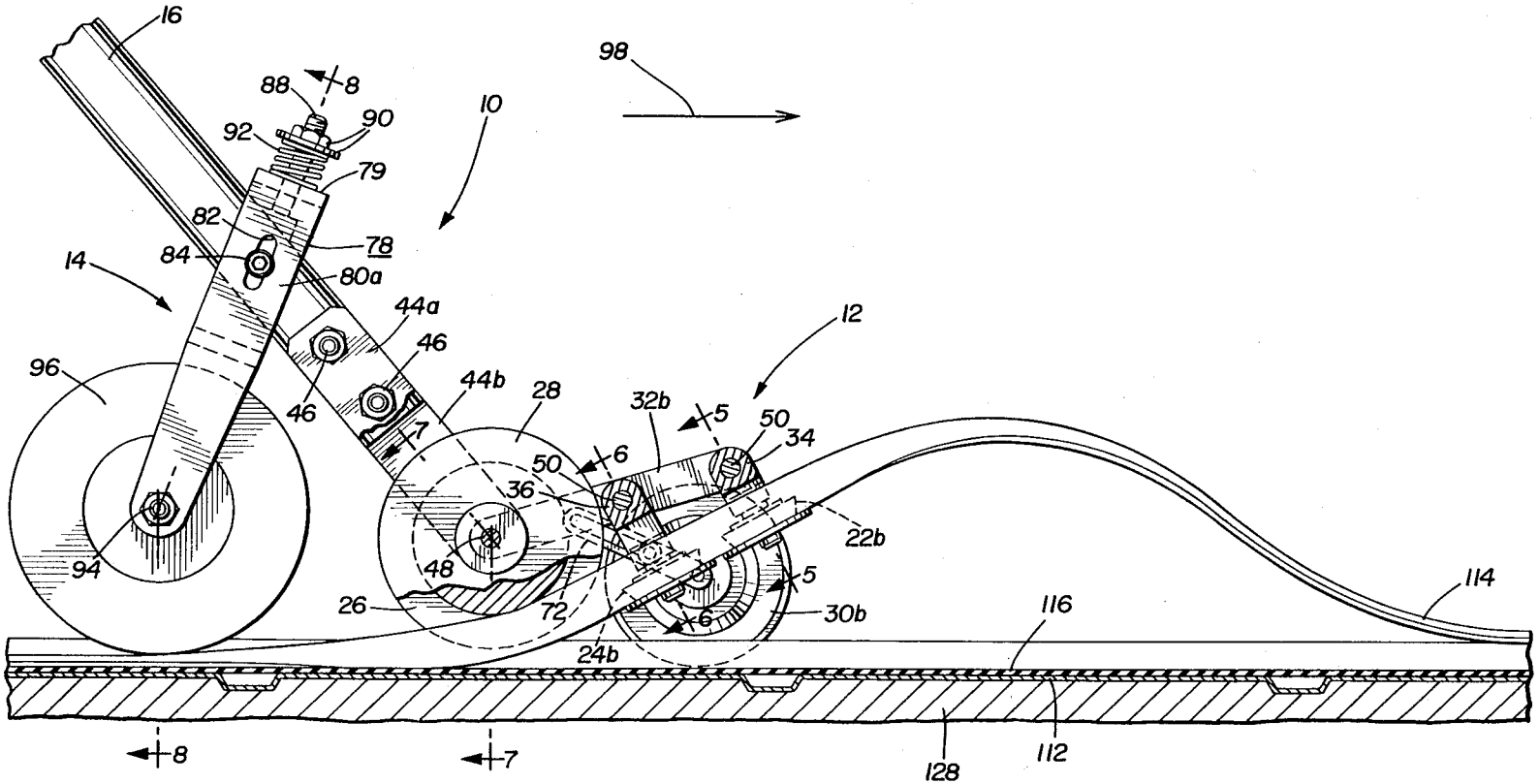
FIG. 4 is a longitudinal section, with parts in elevation, of the tool of FIG. 1.

As best shown in FIG. 4, as tool 10 is displaced to the right, i.e., in the direction of arrow 98, pressing tool wheel member 96 comes into gradual contact with the apex portion of now generally triangularly-shaped flexible insert member 114 and thereafter gradually continues its downward pressure on the apex to fully insert member 114 into channel member 112 and thereafter flatten or return insert member 114 from its inverted V-shape to approximately its natural shape—either substantially flat or slightly concave shape to thereby frictionally and non-bindingly retain the adjacent portions of membrane 116 within channel member 112. Frame assembly 20 is of course supported via axles 38*a*, 38*b* and wheels 30*a*, 30*b* and actuated, relative to substrate 128 via actuating handle 16 and bars 44*a*, 44*b*.

The operation of tool 10 should now be evident from the previous description in conjunction with the several drawings, particularly FIGS. 4–8. As noted, it is the function of the placing assembly 12 tool to initially deform flexible insert member from its flat or slightly concave shape into an inverted V-shape. Thereafter, deformed insert member 114 is fed tangentially into grip and insert wheel 28 which, as its name implies, not only grips at least the apex portion of inverted V-shaped insert member 114 but also inserts or pushes member 114 within the confines of channel member 112. It is the function of support wheels 30*a*, 30*b* to prevent any drag between tool 10 and the roofing structure which, at the time of the insertion of insert member 114 is of course loosely covered with membrane 116. If desired, pressing tool assembly 14 can be separate from placing tool assembly 12 and can, for example, be mounted on a separate actuating handle 16. Fastener tool 10, in the form of either the combination of placing tool assembly 12 and pressing tool assembly 14 or merely utilizing pressing tool assembly 12, is shown here in a manual version, i.e., it is hand actuated but can, of course, be motorized so that, for example, one or more of the rollers, support wheels, grip and insert wheel or pressing wheel member is power driven.

The roofing membrane fastener tools of the present invention, find specific utility in mechanically securing EPDM sheeting in at least flat roofing applications. However, from the foregoing description, when read in light of the several drawings, it is believed that those familiar with the art will readily recognize and appreciate the novel concepts and features of the present invention. Obviously, while the invention has been described in relation to only a limited number of embodiments, numerous variations, changes, substitutions and equivalents will present themselves to persons skilled in the art and may be made without necessarily departing from the scope and principles of this invention. As a result, the embodiments described herein are subject to various modifications, changes and the like without departing from the spirit and scope of the invention with the latter being determined solely by reference to the claims appended hereto.

What is claimed is:

1. An apparatus for mechanically securing a flexible sheet, extending over a channel member, having a central longitudinal slot in its top surface, to said channel member via a flexible resilient strip adapted for retaining adjacent portions of the flexible sheet within said channel member, said apparatus comprising:

a. a frame assembly;

b. means for supporting said frame assembly a predetermined distance above said channel member and said flexible membrane overlaying said channel member and for moving said frame assembly along said channel member;

c. tandem pairs of opposed rearwardly converging tandem roller assemblies rotatably mounted on said frame assembly for receiving and temporarily elastically deforming said strip of resilient material into an inverted V-shape having a width less than that of said channel member slot;

d. a grip and insert wheel rotatably vertically journaled in said frame assembly in tandem with said roller assemblies so that its center plane is coincident with a vertical plane passing through the longitudinal axis of said channel member, said wheel including a peripheral channel for gripping the apex portion of said inverted V-shaped strip and pushing at least a portion of said strip together with abutting portions of said flexible membrane into said channel member; and e. a pressing tool assembly attached to said support means in alignment with said grip and insert wheel, said pressing tool assembly including a rotatably vertically journaled wheel member extending into said channel member slot and having its center plane coincident with a vertical plane passing through the longitudinal axis of said channel member, said wheel member being adapted to come into gradual contact with the apex portion of said inverted V-shaped resilient strip to both fully insert said strip into said channel member and thereafter return said strip to approximately its natural shape to thereby retain adjacent portions of said membrane within said channel member.

2. The apparatus of claim 1 wherein at least a portion of said support means is pivotable relative to said frame assembly.

3. The apparatus of claim 2 wherein said pressing tool assembly is yieldably mounted relative to said support means.

4. The apparatus of claim 3 wherein said flexible membrane is an EPDM elastomeric material.

5. A roofing membrane fastener tool for securing a flexible EPDM membrane, overlaping a channel member, to said channel member via an elongated strip of generally flat resilient material, said channel member being fastened to a roofing substrate and having a predetermined width opening, narrower than the width of said strip, said tool comprising in combination:

a. a frame assembly;

b. means for supporting said frame assembly a predetermined distance above said channel member and said flexible membrane overlaying said channel member and for moving said frame assembly along said channel member over said substrate;

c. two pairs of opposed rearwardly converging tandem roller assemblies rotatably mounted on said frame assembly for receiving and temporarily elastically deforming said strip of resilient material into an inverted V-shape having a width less than that of said channel member opening;

d. a grip and insert wheel rotatably vertically journaled in said frame assembly behind said roller assemblies so that its center plane is coincident with a vertical plane passing through the longitudinal axis of said channel member, said wheel including a peripheral cavity for gripping the apex portion of said inverted V-shaped strip and pushing at least a portion of said strip together with enveloping portions of said flexible membrane into said channel member; and e. a pressing tool assembly attached to said support means in tandem with said grip and insert wheel, said pressing tool assembly including a rotatably vertically journaled wheel member extending into said channel member and having its center plane coincident with a vertical plane passing through the longitudinal axis of said channel member, said wheel member being adapted to come into gradual contact with the apex portion of said inverted V-shaped resilient strip to both fully insert said strip into said channel member and thereafter return said strip to approximately its natural shape to thereby frictionally yet non-bindingly retain enveloping portions of said membrane within said channel member.

6. The roofing membrane fastener of claim 5 wherein at least a portion of said support means is pivotable relative to said frame assembly and wherein said pressing tool assembly is yieldably mounted relative to said support means.

* * * * *